US008960074B2

(12) United States Patent
Hara et al.

(10) Patent No.: US 8,960,074 B2
(45) Date of Patent: Feb. 24, 2015

(54) CAP FOR USE IN FLUID PRESSURE DEVICE AND FIXING METHOD THEREFOR

(75) Inventors: Koji Hara, Tsukubamirai (JP); Yusuke Saito, Shibuya-ku (JP); Toshio Sato, Tsukuba (JP); Hironobu Imamura, Kuki (JP)

(73) Assignee: SMC Kabushiki Kaisha, Tokyo (JP)

( * ) Notice: Subject to any disclaimer, the term of this patent is extended or adjusted under 35 U.S.C. 154(b) by 861 days.

(21) Appl. No.: 13/042,785

(22) Filed: Mar. 8, 2011

(65) Prior Publication Data

US 2011/0240649 A1 Oct. 6, 2011

(30) Foreign Application Priority Data

Apr. 1, 2010 (JP) ..... 2010-085538

(51) Int. Cl.
*B65D 45/16* (2006.01)
*F15B 15/14* (2006.01)

(52) U.S. Cl.
CPC ..... *F15B 15/1438* (2013.01); *F15B 15/1404* (2013.01); *F15B 15/1471* (2013.01)
USPC ..... 92/169.1; 29/522.1

(58) Field of Classification Search
CPC ..... F02F 1/00; F02F 1/24; F16J 13/00; F16J 15/00; F04B 39/125; F04B 53/007; F15B 15/1438; F15B 15/1404; F15B 15/1471
USPC ..... 92/88, 146, 169.1; 251/366; 220/309.1, 220/309.2, 310.1; 29/505, 522.1, 521, 506, 29/507, 512
See application file for complete search history.

(56) References Cited

U.S. PATENT DOCUMENTS 1,801,006 A * 4/1931 Jacoby ..... 220/305
5,265,331 A * 11/1993 Engel et al. ..... 29/888.044
5,884,549 A 3/1999 Hosono et al.
7,654,189 B2 * 2/2010 Kohlmeyer et al. ..... 92/169.1

(Continued)

FOREIGN PATENT DOCUMENTS

JP 58-123904 8/1983
JP 58-123905 U 8/1983
JP 64-33056 3/1989

(Continued)

OTHER PUBLICATIONS

Office Action issued Feb. 4, 2014, in Japanese Patent Application No. 2010-085538 with English translation of pertinent portion.

(Continued)

*Primary Examiner* — Ned Landrum
*Assistant Examiner* — Logan Kraft
(74) *Attorney, Agent, or Firm* — Oblon, Spivak, McClelland, Maier & Neustadt, L.L.P.

(57) ABSTRACT

A pair of penetrating holes are formed along a longitudinal direction in the interior of a cylinder body that constitutes a fluid pressure cylinder. One end of the pair of penetrating holes is sealed by a pair of caps formed in plate-like shapes. The caps, for example, are formed by press molding a plate body made up from a metal material such as aluminum or the like. Outer edge portions of the caps include bent portions, which are inclined at a predetermined angle in a radial outward direction. In addition, the caps are installed by means of the bent portions biting into inner circumferential surfaces of the penetrating holes.

4 Claims, 14 Drawing Sheets

(56) References Cited

U.S. PATENT DOCUMENTS

| | | | | |
|---|---|---|---|---|
| 2004/0045611 | A1* | 3/2004 | Avila | 137/596.17 |
| 2006/0070520 | A1* | 4/2006 | Fish | 92/169.1 |

FOREIGN PATENT DOCUMENTS

| | | | | |
|---|---|---|---|---|
| JP | 4-15306 | A | | 1/1992 |
| JP | 04-125359 | | | 4/1992 |
| JP | 10-220417 | A | | 8/1998 |
| JP | 2000-130405 | A | | 5/2000 |
| JP | 2003-290931 | | | 10/2003 |
| JP | 2005240936 | A | * | 9/2005 |
| JP | 3795968 | | | 4/2006 |
| JP | 2009-257475 | A | | 11/2009 |

OTHER PUBLICATIONS

Office Action issued May 23, 2014 in Chinese Patent Application No. 201110096102.4 with English translation.

Notice of Allowance issued Sep. 9, 2014 in Japanese Patent Application No. 2010-085538 (with English translation).

* cited by examiner 10
14
16
12
18
20
30a
30b
32
34
42
42
64
66
68
70a
70b
72
76
76
76
76
82
86
90
90
90
94
94
96
96
98
A
B 10
70b
84
18
86
70a
76
90
64
76
74
68
76
78b
78a
76
14
66
80
96
16
92b
98
72
94
34
96
94
92a
30b
46
20
30a
46
12
32
24
36
36
24
A
B
22
22

CAP FOR USE IN FLUID PRESSURE DEVICE AND FIXING METHOD THEREFOR

CROSS-REFERENCE TO RELATED APPLICATION

This application is based upon and claims the benefit of priority from Japanese Patent Application No. 2010-085538 filed on Apr. 1, 2010, of which the contents are incorporated herein by reference.

BACKGROUND OF THE INVENTION

1. Field of the Invention

The present invention relates to a cap for use in a fluid pressure device equipped with a body including a chamber into which a pressure fluid is introduced, as well as to a fixing method for fixing the cap in the interior of the chamber.

2. Description of the Related Art

Heretofore, as a transport means for a workpiece or the like, for example, a fluid pressure cylinder, which forms one type of fluid pressure device, has been used. As disclosed in Japanese Patent No. 3795968, SMC Kabushiki Kaisha has proposed a fluid pressure cylinder, which is capable of transporting a workpiece mounted on a slide table, by reciprocally moving the slide table in a straight line along the cylinder main body. The aforementioned fluid pressure cylinder comprises a cylinder main body having a cylinder chamber therein to which a pressure fluid is supplied. A piston is accommodated in the cylinder chamber, the piston being displaceable along an axial direction upon supply of the pressure fluid. Further, a cover member having a sealing ring on an outer circumferential surface thereof is installed in an end portion of the cylinder chamber in order to seal the cylinder chamber, so that pressure fluid inside the cylinder chamber does not leak out to the exterior.

SUMMARY OF THE INVENTION

A general object of the present invention is to provide a cap for use in a fluid pressure device as well as a fixing method, which is capable of reliably preventing leakage of a pressure fluid while reducing manufacturing costs and the number of parts, as well as reducing the number of assembly steps required for assembly and installation of the cap.

The present invention is a cap for use in a fluid pressure device for sealing an open end portion of a chamber in the fluid pressure device, which includes a body having the chamber therein into which a pressure fluid flows.

The cap comprises a deformable section made up from a plate body that corresponds to a cross sectional shape of the chamber and which is expandable in diameter in a radial outward direction, and a latching section disposed on an outer edge portion of the deformable section and which is latchable with respect to an inner wall surface of the chamber.

According to the present invention, the cap is equipped with the deformable section, which is expandable in diameter in a radial outward direction, and a latching section disposed on an outer edge portion of the deformable section and which is latchable with respect to an inner wall surface of the chamber. In addition, the deformable section is expanded in diameter by deformation thereof, and by latching of the latching section with respect to the inner wall surface, the cap can be fixed reliably in the chamber and seal the chamber.

Accordingly, because a latching ring for fixing the cap for use in a pressure fluid device according to the conventional art, a groove for installation of the latching ring therein, and an o-ring or the like disposed on an outer peripheral surface of the cap are rendered unnecessary, manufacturing costs and the number of parts needed for the fluid pressure device can be decreased, and accompanying a reduction in the number of assembly steps, manufacturing efficiency can be enhanced.

The above and other objects features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
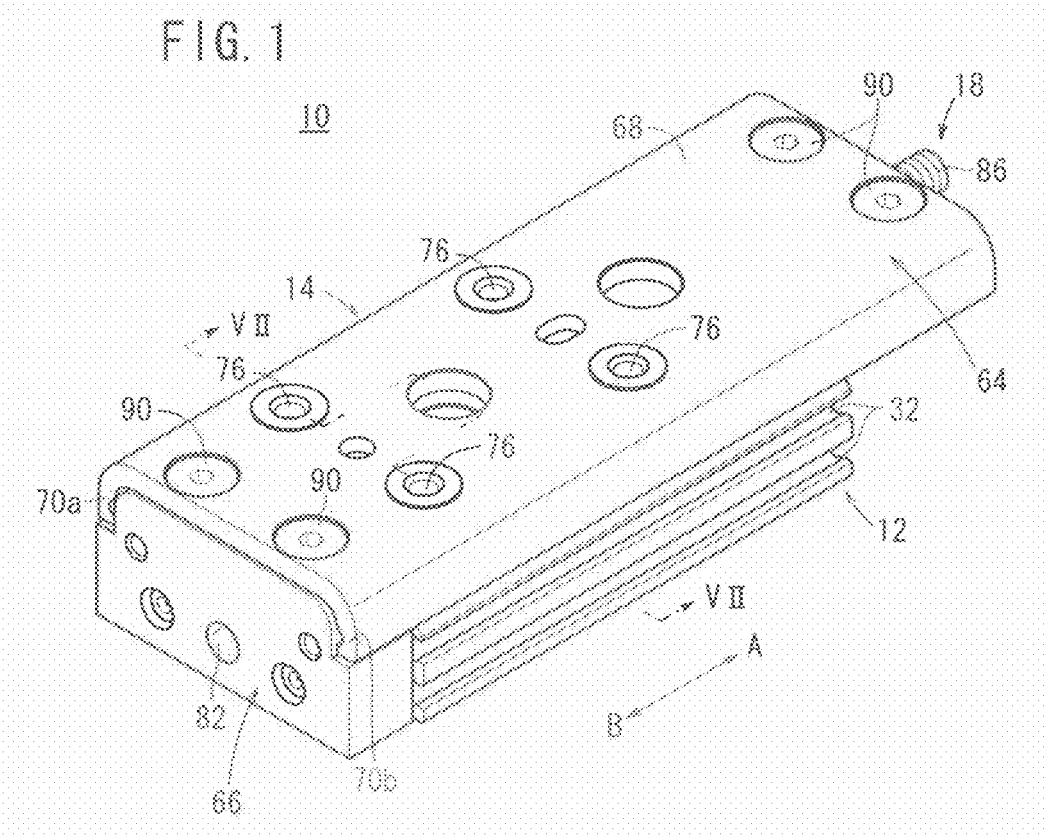
FIG. 1 is an external perspective view of a fluid pressure cylinder in which a cap according to a first embodiment of the present invention is used.
Figure 2:
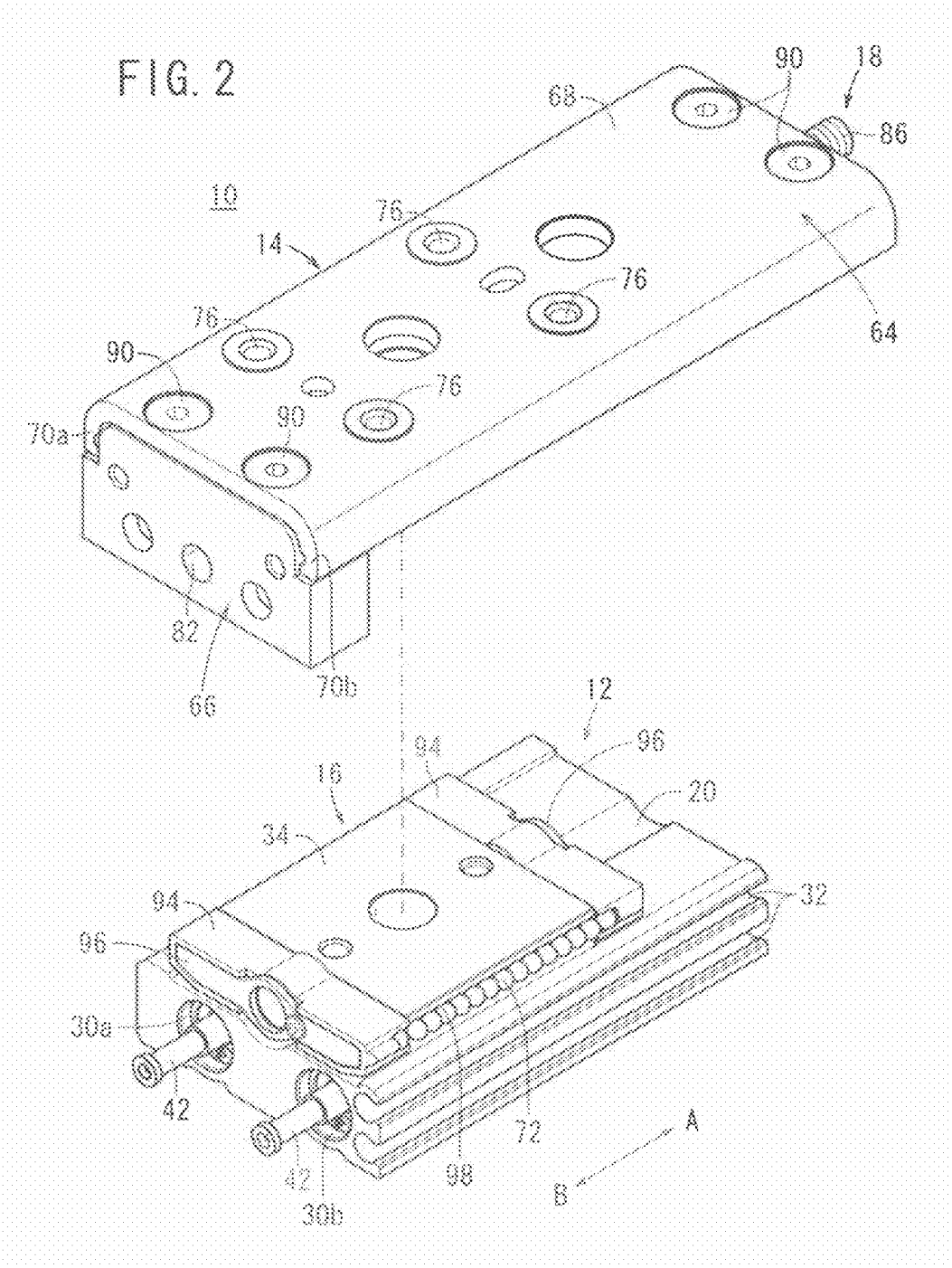
FIG. 2 is an exploded perspective view showing a condition in which a slide table is separated upwardly away from the fluid pressure cylinder of FIG. 1.

In FIG. 1, reference numeral 10 indicates a fluid pressure cylinder as a fluid pressure device in which a cap according to an embodiment of the present invention is used.

As shown in FIGS. 1 through 7, the fluid pressure cylinder 10 includes a cylinder main body (body) 12, a slide table 14 disposed on an upper part of the cylinder main body 12 and which is moved reciprocally in a straight line along a longitudinal direction (the direction of arrows A and B), a guide mechanism 16 interposed between the cylinder main body 12 and the slide table 14, which guides the slide table along the longitudinal direction (the direction of arrows A and B), and an adjustable stopper mechanism 18 capable of adjusting a displacement amount of the slide table 14.

The cylinder main body 12, for example, is formed with an elongate shape in cross section having a predetermined length along the longitudinal direction (the direction of arrows A and B) from a metal material such as aluminum or the like. In addition, a recess 20, which is recessed in an arcuate shape in cross section, is formed roughly in the center on the upper surface of the cylinder main body 12 extending along the longitudinal direction (the direction of arrows A and B). A pair of bolt holes 24, through which connecting bolts 22 are inserted that interconnect the cylinder main body 12 and the guide mechanism 16, penetrate through the recess 20.

Figure 5:
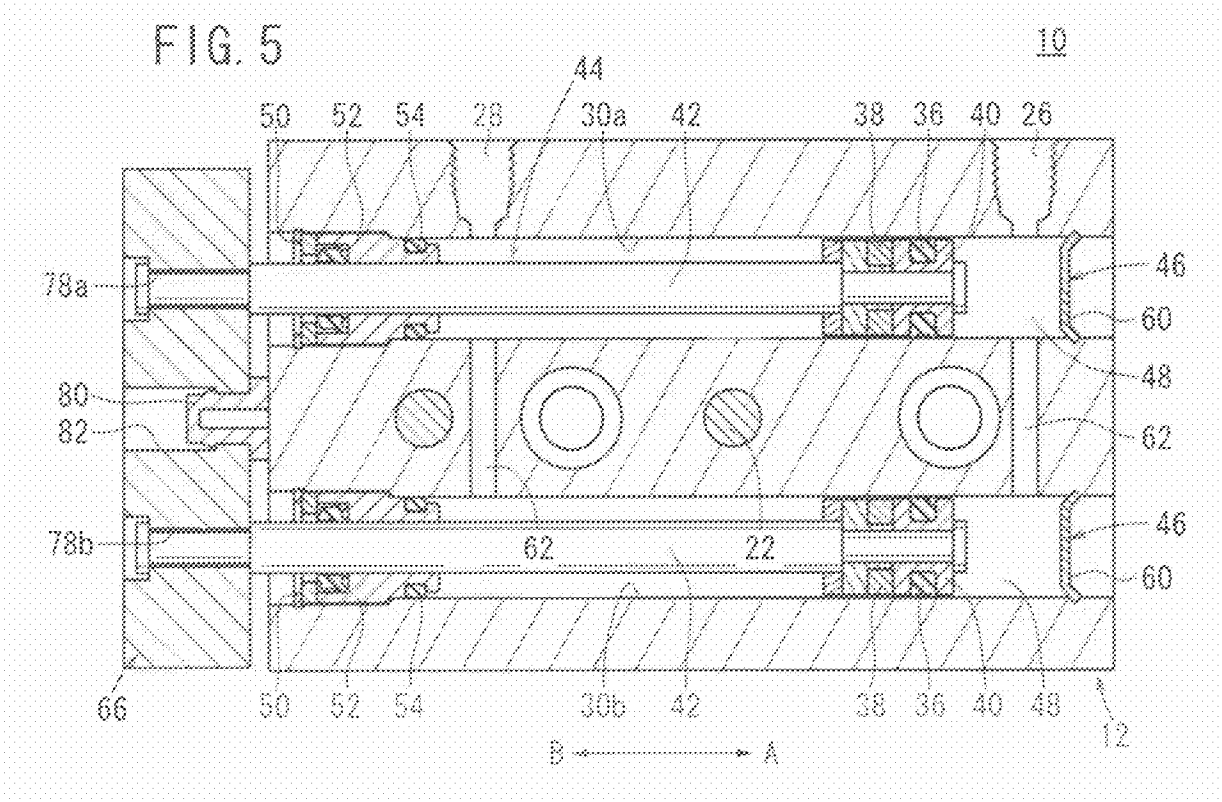
FIG. 5 is a cross sectional view taken along line V-V of FIG. 4.

Further, on one side surface of the cylinder main body 12, as shown in FIG. 5, first and second ports 26, 28 through which a pressure fluid is supplied and discharged are formed perpendicular to the longitudinal direction of the cylinder main body 12, and communicate with a pair of penetrating holes 30*a*, 30*b* to be described later. Also, on the other side surface of the cylinder main body 12, two rows of sensor attachment grooves 32 are formed respectively along the longitudinal direction (the direction of arrows A and B) into which non-illustrated sensors may be installed.

On the lower surface of the cylinder main body, a pair of bolt holes 24 are formed on the axial line centrally in the widthwise direction, with the connecting bolts 22 being inserted therethrough from below. Additionally, ends of the connecting bolts 22 protrude from the upper surface of the cylinder main body 12, which are connected mutually with a guide block 34 of the guide mechanism 16 by screw-engagement therewith.

On the other hand, in the interior of the cylinder main body 12, a pair of penetrating holes 30*a*, 30*b*, which penetrate along the longitudinal direction (the direction of arrows A and B), are formed having circular shapes in cross section. The one penetrating hole 30*a* and the other penetrating hole 30*b* are aligned substantially in parallel and are separated from one another by a predetermined distance.

In the interior of the penetrating holes 30*a*, 30*b*, a cylinder mechanism 44 is provided, including pistons (displaceable bodies) 40 having sealing rings 36 and magnets 38 installed on an outer circumferential surface thereof, and piston rods 42 connected to the pistons 40. The cylinder mechanism 44 is constructed by installing the pair of pistons 40 and the piston rods 42 respectively in the penetrating holes 30*a*, 30*b*.

End portions of the penetrating holes 30*a*, 30*b* are sealed by a pair of caps 46, which are formed in a plate-like shape, thereby forming respective cylinder chambers (chambers) 48 between the pistons 40 and the caps 46. Further, other end portions of the penetrating holes 30*a*, 30*b* are sealed hermetically by rod holders 52, which are retained therein via locking rings 50. O-rings 54 are installed via annular grooves on the outer circumferential surfaces of the rod holders 52, so as to prevent leakage of pressure fluid therethrough that has passed between the penetrating holes 30*a*, 30*b*.

Figure 8:
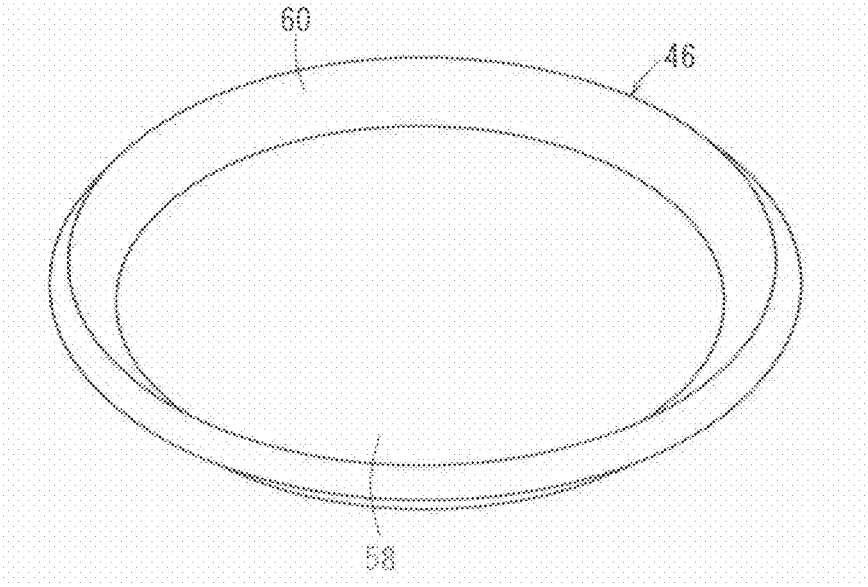
FIG. 8 is a simple perspective view of a cap shown in FIG. 5.
Figure 9:
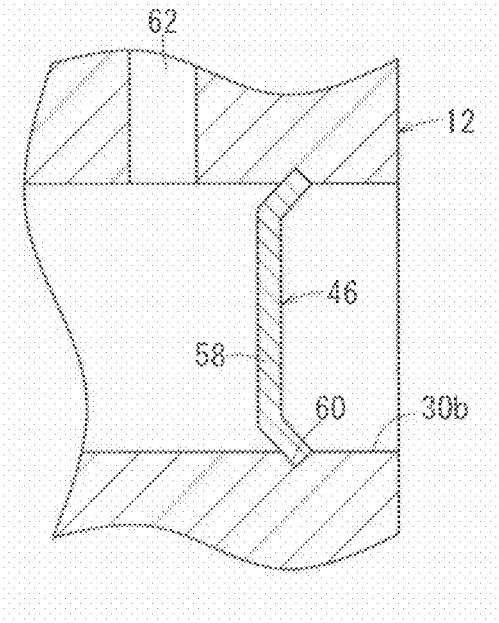
FIG. 9 is an enlarged cross sectional view of a vicinity of the cap in the fluid pressure cylinder shown in FIG. 5.

As shown in FIGS. 8 and 9, each of the caps 46 is made up from a disk shaped main body portion (deformable section) 58 formed by press molding a plate body 56 made from a metal material such as aluminum or the like, and a bent portion (latching section) 60 formed on an edge of a main body portion 58, which is inclined by a predetermined angle in a radial outward direction. The bent portions 60 of the caps 46 are disposed so as to confront one end side (in the direction of arrow A) of the penetrating holes 30*a*, 30*b*, which initially are opened.

Stated otherwise, the bent portions 60 of the caps 46 are arranged in the cylinder main body 12 so as to confront an opposite side of the cylinder chambers 48.

Further, in each of the caps 46, the outside diameter of the bent portion 60 is set to be slightly greater than the inside diameters of the penetrating holes 30*a*, 30*b*. The caps 46, for example, may be formed from the same aluminum material as the cylinder main body 12. However, the hardness E1 of the caps 46 is set to be greater than the hardness E2 of the cylinder main body 12 (E1>E2).

More specifically, when the caps 46 are installed in the penetrating holes 30*a*, 30*b* of the cylinder main body 12, the bent portions 60 of the caps 46 are installed so as to bite into the inner circumferential surfaces of the penetrating holes 30*a*, 30*b*. In greater detail, the inclined portions of the outer peripheral sides that make up the bent portions 60 bite into the inner circumferential surfaces of the penetrating holes 30*a*, 30*b* at a predetermined depth, such that the caps 46 are fixed firmly in the interior of the penetrating holes 30*a*, 30*b*.

Furthermore, an alumite treatment or the like, for example, is effected on the caps 46. The thickness of a treated layer that is formed by such surface processing is set, for example, on the order of 5 to 30 μm. Surface processing carried out with respect to the caps 46 is not limited to the aforementioned alumite treatment, but may be carried out, for example, by a chromate treatment, or by application of a coating or the like.

One of the penetrating holes 30*a* communicates respectively with the first and second ports 26, 28, whereas the other penetrating hole 30*b* communicates via a pair of connecting passages 62, which are formed between the one penetrating hole 30*a* and the other penetrating hole 30*b*. More specifically, pressure fluid, which is supplied to the first and second ports 26, 28, after having been introduced into the one penetrating hole 30*a*, flows through the connecting passages 62 and is introduced into the other penetrating hole 30*b*.

The slide table 14 comprises a table main body 64, a stopper mechanism 18 connected to one end of the table main body 64, and an end plate 66 connected to the other end of the table main body 64. The end plate 66 is connected perpendicularly with respect to the table main body 64.

The table main body 64 is made up from a base portion 68 that extends in the longitudinal direction (the direction of arrows A and B), and a pair of guide walls 70*a*, 70*b* that extend perpendicularly downward from opposite sides of the base portion 68. On inside surfaces of the guide walls 70*a*, 70*b*, first ball guide grooves 74 are formed in which balls 72 of a later-described guide mechanism 16 are guided. Four workpiece retaining holes 76 are formed respectively between one end and the other end of the base portion 68.

The end plate 66 is fixed to the other end of the table main body 64 and is disposed to face toward the end surface of the cylinder main body 12, and together therewith, ends of the piston rods 42, which are inserted through the pair of rod holes 78*a*, 78*b*, are affixed respectively to the end plate 66. Owing thereto, the slide table 14 including the end plate 66 is displaced together with the piston rods 42 in the longitudinal direction (the direction of arrows A and B) of the cylinder main body 12.

Further, in the end plate 66, at a position between one rod hole 78*a* and the other rod hole 78*b*, a damper installation hole 82 opens, into which a damper 80 is installed. For example, when the damper 80, which is formed from an elastic material such as rubber or the like, is installed in the damper installation hole 82 from the other side surface of the end plate 66 on the side of the cylinder main body 12, an end of the damper 80 is expanded in diameter and projects from the other end surface.

The stopper mechanism 18 includes a holder portion 84, which is disposed on a lower surface on one end on the table main body 64, a stopper bolt 86, which is screw-engaged with respect to the holder portion 84, and a lock nut 88 that regulates advancing and retracting movements of the stopper bolt 86. The stopper mechanism 18 is disposed so as to face toward an end surface of the guide mechanism 16, which is disposed on the cylinder main body 12.

The holder portion 84 is formed in a block shape and is affixed from the top thereof by bolts 90 with respect to a base portion 68 of the table main body 64 that makes up the slide table 14. Roughly in the center of the holder portion 84, the stopper bolt 86 is screw-engaged so as to be capable of advancing and retracting along the axial direction. The stopper bolt 86, for example, is made of a rod-shaped stud bolt, which is engraved with threads on the outer circumferential surface thereof, and the lock nut 88 is screw-engaged on a location thereof that projects from the end surface of the holder portion 84.

Additionally, by screw rotation of the stopper bolt 86 with respect to the holder portion 84, the stopper bolt 86 is displaced along the axial direction (the direction of arrows A and B) so as to approach and move away from the guide mechanism 16. For example, after the stopper bolt 86 is rotated and is made to project a predetermined length toward the side of the guide mechanism 16 (in the direction of arrow B), the lock nut 88 is screw rotated and moved so as to abut against the side surface of the holder portion 84. As a result, advancing and retracting movements of the stopper bolt 86 with respect to the holder portion 84 are regulated.

Figure 3:
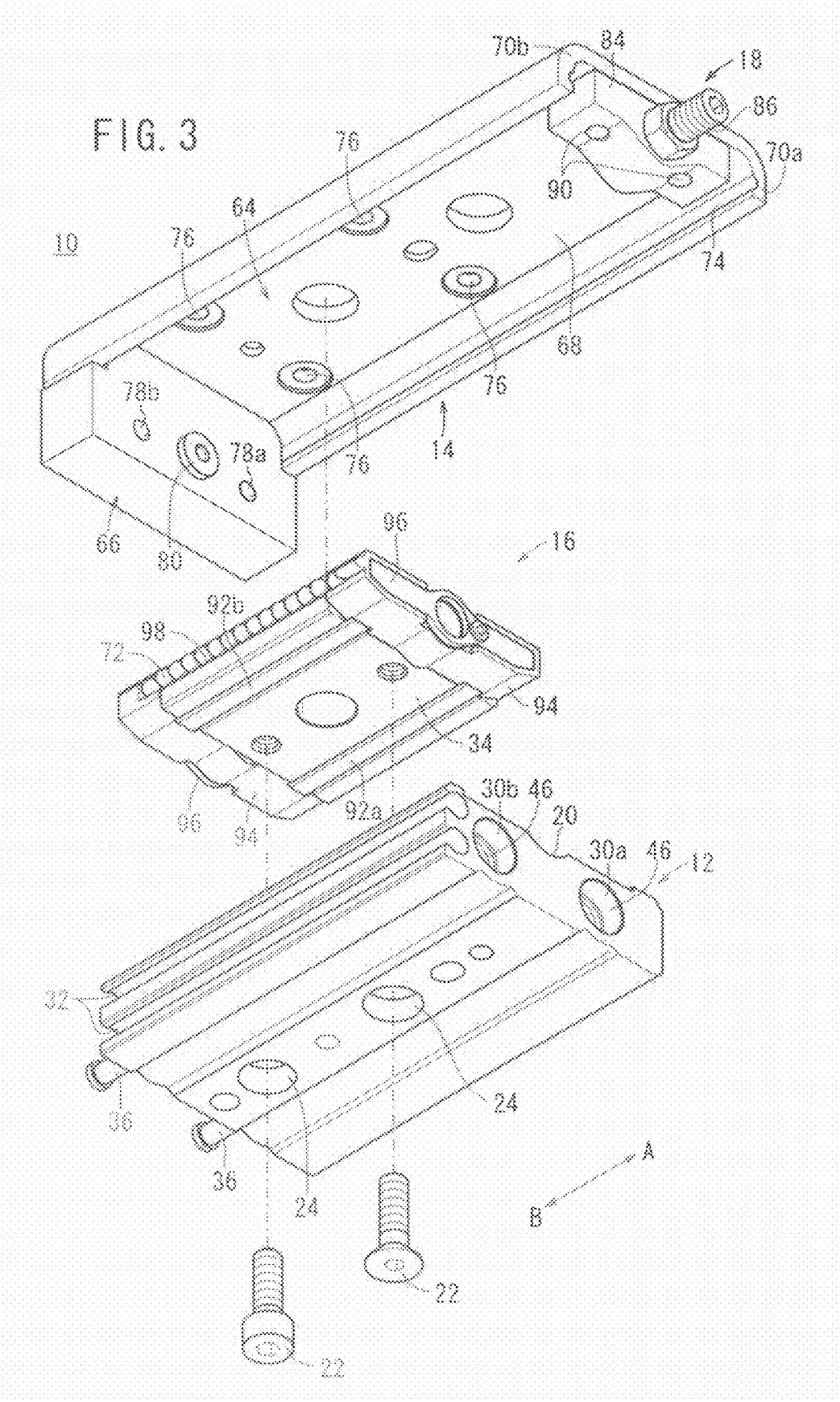
FIG. 3 is an exploded perspective view as seen from a lower side of the fluid pressure cylinder of FIG. 1.
Figure 6:
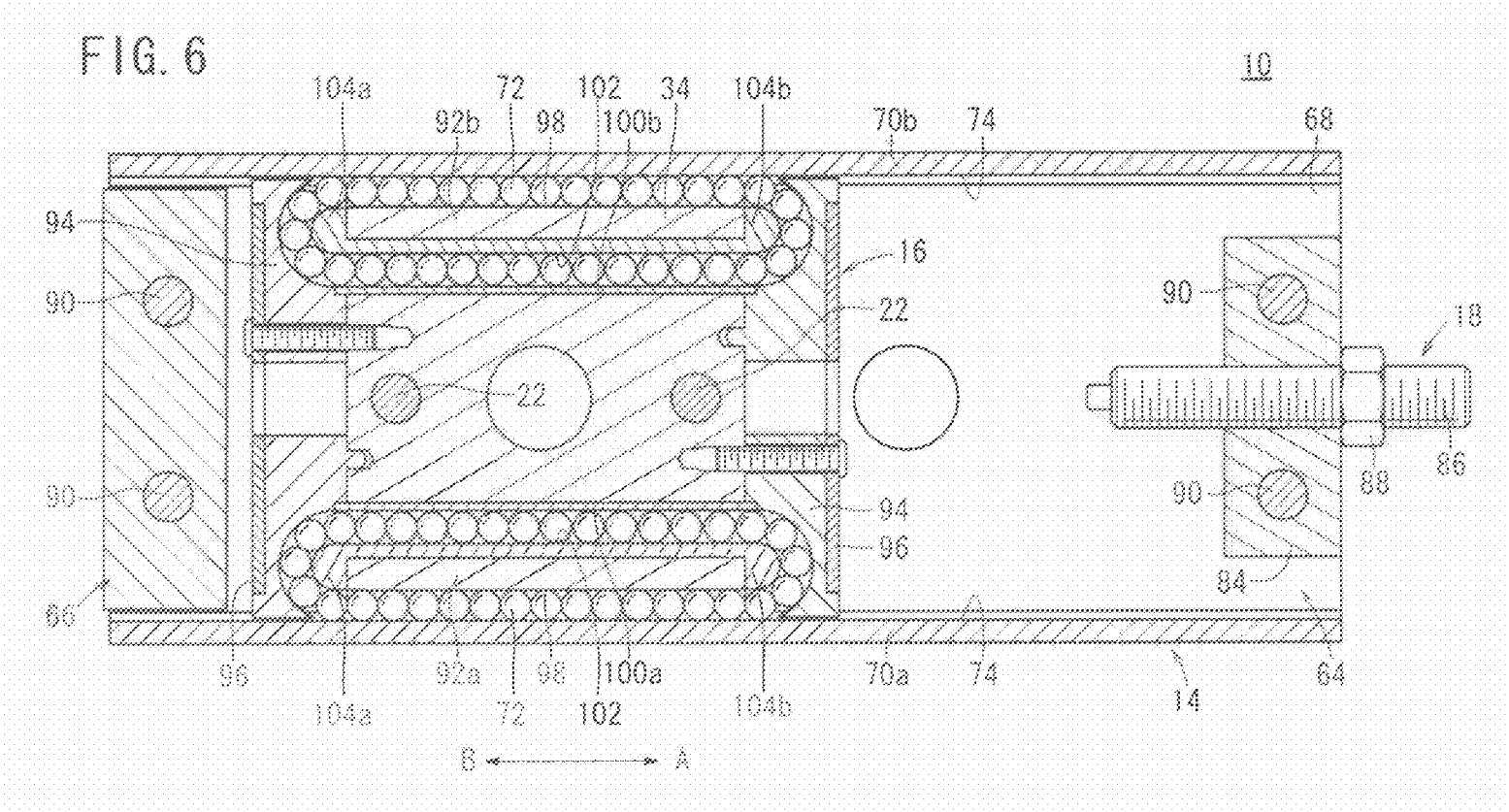
FIG. 6 is a cross sectional view taken along line VI-VI of FIG. 4.
Figure 7:
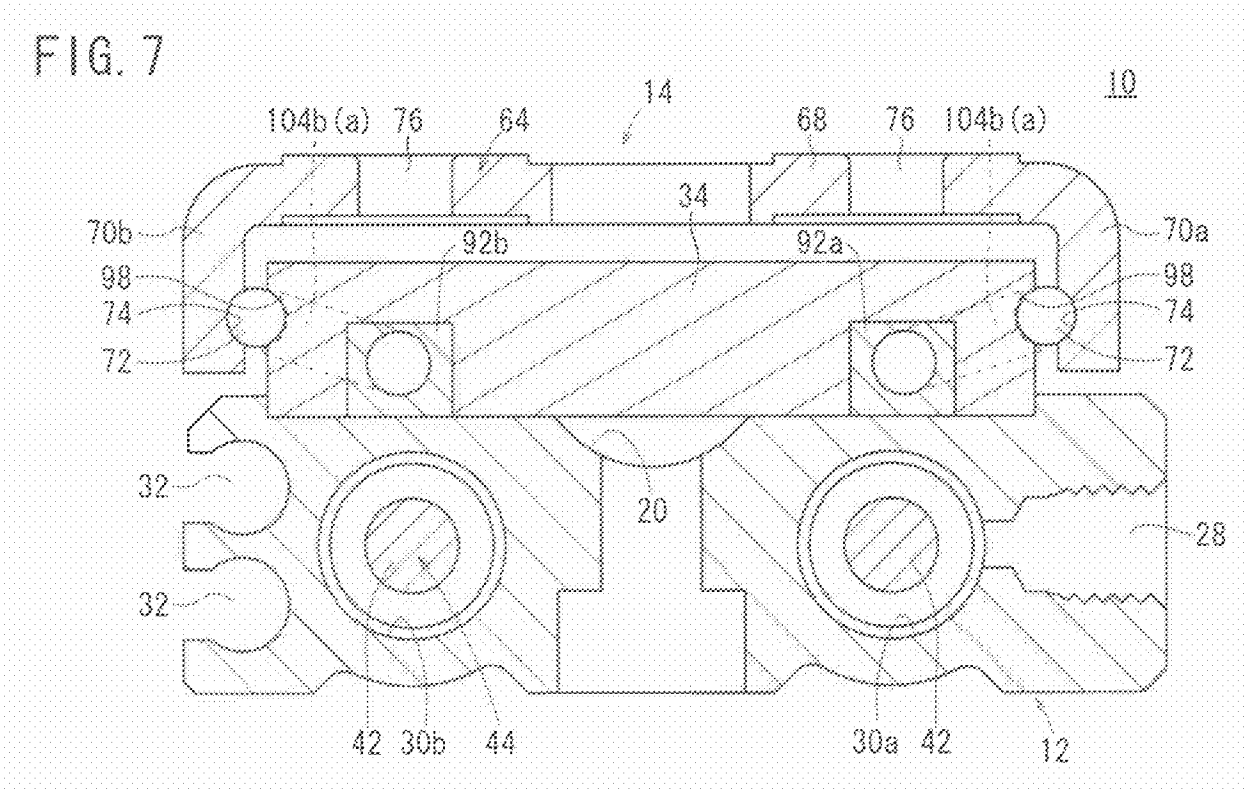
FIG. 7 is a cross sectional view taken along line VII-VII of FIG. 1.

As shown in FIGS. 3, 6 and 7, the guide mechanism 16 includes a wide and flat shaped guide block 34, a pair of ball circulating members 92*a*, 92*b* disposed on the guide block 34 and through which balls 72 circulate, a pair of covers 94 installed respectively on opposite ends along the longitudinal direction of the guide block 34, and a pair of cover plates 96 that cover respective surfaces of the covers 94. The covers 94 are installed so as to cover opposite end surfaces of the guide block 34.

On opposite side surfaces of the guide block 34, second ball guide grooves 98 are formed along the longitudinal direction, and at locations proximate the second ball guide grooves 98, a pair of installation grooves 100*a*, 100*b* into which the ball circulating members 92*a*, 92*b* are inserted penetrate in the longitudinal direction. The second ball guide grooves 98 are formed with semicircular shapes in cross section, such that when the guide mechanism 16 is arranged on the upper portion of the slide table 14, the second ball guide grooves 98 are formed at positions confronting the first ball guide grooves 74.

Installation grooves 100*a*, 100*b* are formed on a lower surface of the guide block 34, and the ball circulating members 92*a*, 92*b* are disposed in the interior thereof. Ball circulation holes 102 through which the balls 72 circulate penetrate through the interior of the ball circulating members 92*a*, 92*b*, and together therewith, a pair of reversing members 104*a*, 104*b*, which reverse the circulating direction of the balls 72, are disposed respectively at opposite end portions of the ball circulation holes 102. Owing thereto, ball circulation passages, which are connected in an annular fashion, are formed by the ball circulation holes 102 of the ball circulating members 92*a*, 92*b*, the ball grooves, the first ball guide grooves 74 of the slide table 14, and the second ball guide grooves 98 of the guide block 34. By rolling of the plural balls 72 along the ball circulation passages, the slide table 14 is moved smoothly in a reciprocating fashion along the guide mechanism 16.

Figure 10A:
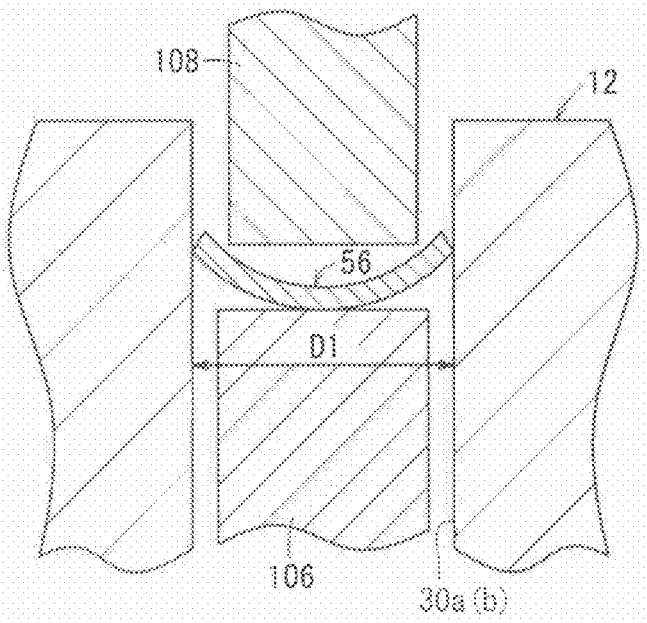
FIG. 10A is an enlarged cross sectional view showing a condition in which a plate body is inserted in a penetrating hole and arranged between first and second punches.

The fluid pressure cylinder 10 in which caps 46 according to the embodiment of the present invention are used is constructed basically as described above. Next, with reference to FIGS. 10A and 10B, a case shall be described of assembling the caps 46 with respect to the cylinder main body 12.

At first, under a condition in which the pistons 40 and the piston rods 42 are not inserted through the penetrating holes 30*a*, 30*b* of the cylinder main body 12 that constitutes the fluid pressure cylinder 10, a preparatory condition is set up in which one end of the cylinder main body 12 is arranged in an upwardly directed orientation.

In this preparatory state, a first punch (molding jig) 106 is inserted with respect to the penetrating holes 30*a*, 30*b* from the other end (i.e., the bottom side) of the cylinder main body 12, such that an end thereof is positioned at an installation position of the cap 46 in the penetrating holes 30*a*, 30*b*. The first punch 106 is made up from a rod-shaped body, the end of which is planar shaped, and the diameter of which is set slightly smaller than the inner circumferential diameter of the penetrating holes 30*a*, 30*b*. At this time, the first punch 106 and the penetrating holes 30*a*, 30*b* are disposed coaxially, and the end surface of the first punch is arranged roughly perpendicularly to axes of the penetrating holes 30*a*, 30*b*.

Next, plate bodies 56 that form bases of the caps 46 are inserted from one end side, i.e., the upper side, of the penetrating holes 30*a*, 30*b*. The plate body 56 is formed with a curved shape in cross section having a roughly constant thickness. The outside diameter of the plate body 56 is formed to be slightly smaller than the inside diameter of the penetrating holes 30*a*, 30*b*.

Stated otherwise, the cross sectional area of the plate body 56 is set roughly the same or less than the cross sectional area of the penetrating holes 30*a*, 30*b*.

Additionally, the plate body 56 is inserted into the penetrating holes 30*a*, 30*b* such that the bulging center portion thereof is oriented downwardly, and the plate body 56 is placed in a state of resting on the end surface of the first punch 106. At this time, because the plate body 56 is formed to be smaller than the inner circumferential surface of the penetrating holes 30*a*, 30*b*, upon insertion thereof, the plate body 56 does not move while sliding along the inner circumferential surface, so that damage to the inner wall surface is avoided.

Figure 10B:
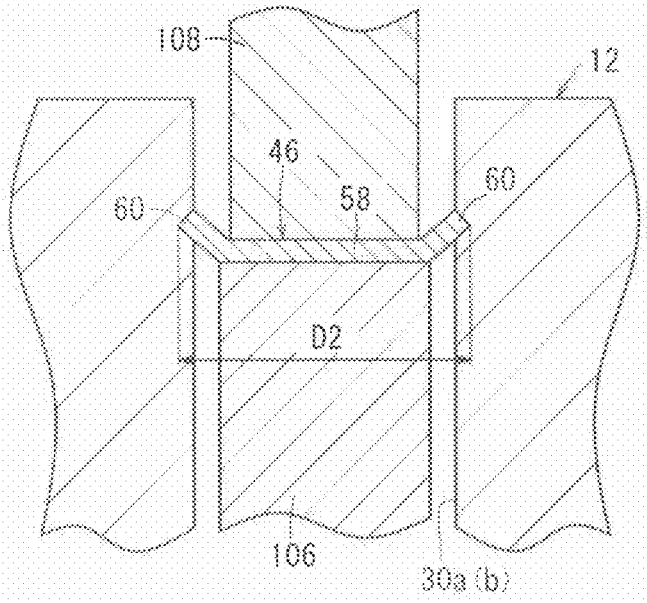
FIG. 10B is an enlarged cross sectional view showing a condition in which the plate body is expanded in diameter by the first punch and the second punch to form the cap.

Lastly, as shown in FIG. 10B, a second punch (molding jig) 108 is inserted from the one end side, i.e., from an upper side of the penetrating holes 30*a*, 30*b*, and is lowered with a predetermined pressing force. The second punch 108, similar to the first punch 106, is made up from a rod-shaped body the bottom end surface of which is planar shaped, and the diameter of which is set to be smaller than the diameter of the first punch 106.

Additionally, as shown in FIG. 10B, by lowering the second punch 108, the plate body 56 is gripped and pressed between the end surface of the second punch 108 and the end surface of the first punch 106, and by the pressing force thereof, the planar shaped main body portion 58 is formed between the first punch 106 and the second punch 108, and on the outer edge thereof, the bent portion 60 is formed in a state of being bent upwardly. Stated otherwise, the plate body 56 is made into the cap 46, in which the region thereof gripped by the first punch 106 and the second punch 108 becomes the planar shaped main body portion 58, and the outer edge of the main body portion 58 becomes the bent portion 60, which is expanded in diameter in a radial outward direction and plastically deformed upwardly.

At this time, as a result of the bent region being plastically deformed in a planar shape, the plate body 56 is expanded in diameter in a radial outward direction, such that the diameter D2 of the cap 46 formed by plastic deformation becomes greater than the diameter D1 of the plate body 56 (D2>D1). Moreover, as a result of being press molded by the first and second punches 106, 108, the outer edge of the cap 46 is expanded in diameter in a radial outward direction with respect to the plate body 56, and the bent portion 60 formed at the outer edge bites somewhat into the inner wall surfaces of the penetrating holes 30*a*, 30*b*, whereby the caps 46 are fixed with respect to the penetrating holes 30*a*, 30*b*.

In the foregoing manner, with the first embodiment, after the plate bodies 56, which form the base of the caps 46, have been inserted in the interior of the penetrating holes 30*a*, 30*b*, because the caps 46 are formed as a result of being expanded radially outward in diameter, at the time of installation, the caps 46 are not inserted while being in sliding contact with inner wall surfaces of the penetrating holes 30*a*, 30*b*. Owing thereto, compared to a conventional pressure cylinder in which caps 46 are inserted from end sides of the penetrating holes 30*a*, 30*b*, damage (lacerations, lesions) along the axial direction with respect to inner circumferential surfaces of the penetrating holes 30*a*, 30*b* does not occur, and a certain degree of leakage of pressure fluid through such damaged areas is advantageously avoided.

Furthermore, because the caps 46 are fixed at desired positions along the axial direction of the penetrating holes 30*a*, 30*b*, locking rings for fixing the caps 46, grooves for installation of such locking rings, and o-rings disposed on outer circumferential surfaces of the caps 46, as have been used in fluid pressure cylinders according to the conventional art, become unnecessary and can be dispensed with. Consequently, manufacturing costs and the number of parts used in the fluid pressure cylinder 10 can be reduced, together with enhancing manufacturing efficiency.

Still further, because the bent portions 60 of the caps 46 are positioned to face toward the opposite side of the cylinder chambers 48, even in the case that pressing forces from the pistons 40 are applied with respect to the caps 46, pressure from the pressure fluid in the cylinder chambers 48 is applied thereto, and the caps 46 are pressed in a direction away from the cylinder chambers 48, and due to the pressing forces, the bent portions 60 are made to bite further into the inner circumferential walls of the penetrating holes 30*a*, 30*b*, whereby the caps 46 are reliably prevented from dropping out from the penetrating holes 30*a*, 30*b*. More specifically, the bent portions 60 serve a dropout preventative function to prevent dropping out of the caps 46.

Still further, because a surface treatment is performed with respect to the caps 46, by means of such a surface treatment, coating or the like, the caps 46 can be placed in tight intimate contact with the inner circumferential walls of the penetrating holes 30*a*, 30*b* in the cylinder main body 12. As a result, even minute amounts of leakage between the caps 46 and the penetrating holes 30*a*, 30*b* of the cylinder main body 12 can reliably be prevented.

Further, since the caps 46 are formed from the same material as the cylinder main body 12, the linear expansion coefficients thereof are the same and the amount of deformation upon heating thereof is the same. Owing thereto, even in the event that the fluid pressure cylinder 10 experiences a change in temperature, the rate of change of the cylinder main body 12 and the caps 46 is the same, and thus gaps are not generated therebetween. As a result, leakages caused by temperature changes can reliably be prevented. Moreover, because the caps 46 and the cylinder main body 12 can be made to adhere to each other, even minute amounts of leakage passing between the caps 46 and the penetrating holes 30*a*, 30*b* of the cylinder main body 12 can reliably be prevented.

Furthermore, because the hardness of the cylinder main body 12 is formed to be less than the hardness of the caps 46, the caps 46 can be installed while biting into the inner circumferential surfaces of the penetrating holes 30*a*, 30*b* in the cylinder main body 12. As a result, the caps 46 are fixed reliably and in strong fitting engagement with respect to the cylinder main body 12.

Further, because the cylinder main body 12 and the caps 46 are both formed from aluminum, after the caps 46 have been installed with respect to the cylinder main body 12, it is possible to perform surface processing such as an alumite treatment thereon in an integrated manner. As a result, the processing agent infiltrates between the caps 46 and the cylinder main body 12 when surface processing is carried out, so that even slight gaps therebetween become blocked, minute leakages can be prevented, and the number of manufacturing steps can be decreased.

Furthermore, because the caps 46 are formed from a plate-shaped metal material, even in the case that the pistons 40 abut against and are stopped by the caps 46, the caps 46 are elastically deformed upon abutment, and shocks applied thereto from the pistons 40 can be buffered.

Figure 4:
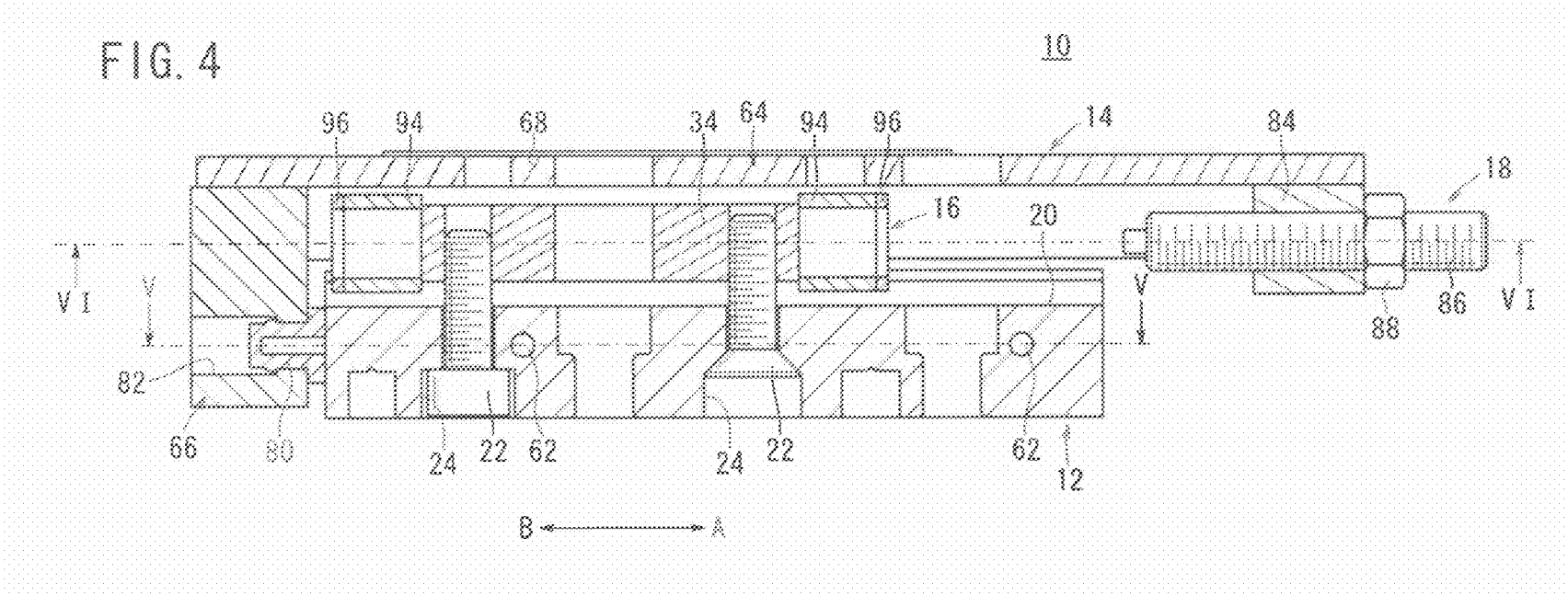
FIG. 4 is an overall vertical cross sectional view of the fluid pressure cylinder of FIG. 1.

Next, operations of the fluid pressure cylinder 10 in which the above-described caps 46 have been assembled will be described. A state in which the end plate 66 of the slide table 14 abuts against an end surface of the cylinder main body 12, as shown in FIG. 4, shall be referred to as an initial position.

First, a pressure fluid from a non-illustrated pressure fluid supply source is introduced into the first port 26. In this case, the second fluid inlet/outlet port is placed in a condition of being open to atmosphere by operation of a non-illustrated switching valve.

Pressure fluid supplied to the first port 26 is supplied into one of the penetrating holes 30*a*, and together therewith, while passing through the connecting passage 62, the pressure fluid is supplied to the other penetrating hole 30*b* as well, whereupon the pistons 40 are pressed toward the side of the rod holders 52 (in the direction of arrow B). Consequently, the piston rods 42 connected to the pistons 40 are displaced together with the slide table 14 in a direction to separate away from the cylinder main body 12.

At this time, accompanying displacement of the slide table 14, the balls 72 that constitute the guide mechanism 16 roll along the ball circulating passages, whereby the slide table 14 is guided in an axial direction by the guide mechanism 16.

Additionally, by abutment of the end of the stopper bolt 86, which is disposed on one end of the slide table 14, against the end surface of the guide block 34 that constitutes the guide mechanism 16, displacement of the slide table 14 is stopped at its displacement terminal end position.

In the stopper mechanism 18, after the lock nut 88 has been loosened, thus enabling the stopper bolt 86 to be advanced and retracted, the stopper bolt 86 is screw-rotated such that the amount by which the stopper bolt 86 projects from the end surface of the holder portion 84 is adjusted, thereby enabling the displacement amount of the slide table 14 to be adjusted.

On the other hand, in the case that the slide table 14 is displaced in an opposite direction from the aforementioned displacement terminal end position, pressure fluid, which formerly was supplied to the first port 26, is supplied instead to the second port 28 while the first port 26 is placed in a state of being open to atmosphere. Owing thereto, the pistons 40 are pressed in a direction to separate away from the rod holders 52 (in the direction of arrow A). Consequently, the pistons 40 are displaced in a direction to separate away from the cylinder main body 12 by the pressure fluid which is supplied into the pair of penetrating holes 30*a*, 30*b* from the second port 28, and the slide table 14 is displaced through the piston rods 42 together with the pistons 40 in a direction to approach the cylinder main body 12. In addition, by abutment of the damper 80, which is disposed on the end plate 66 of the slide table 14, against the end surface of the cylinder main body 12, the initial position is restored (see FIG. 4).

Figure 11A:
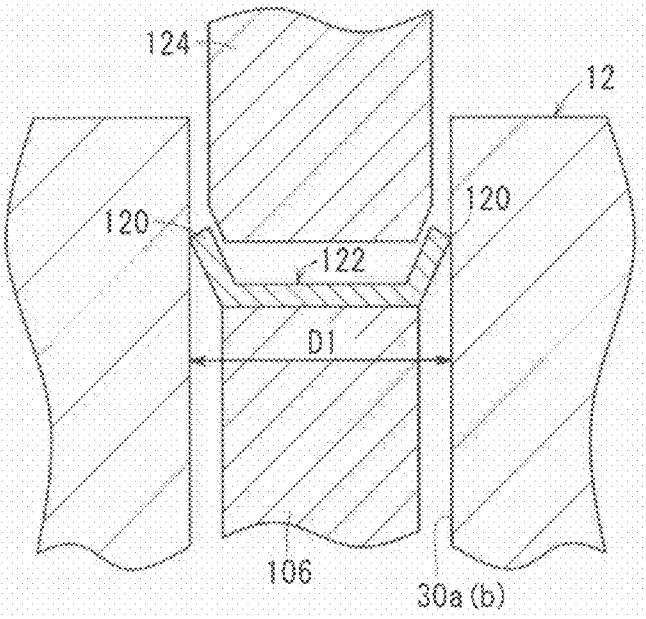
FIG. 11A is an enlarged cross sectional view showing a condition in which a plate body according to a first modification is inserted in a penetrating hole and arranged between first and second punches.
Figure 11B:
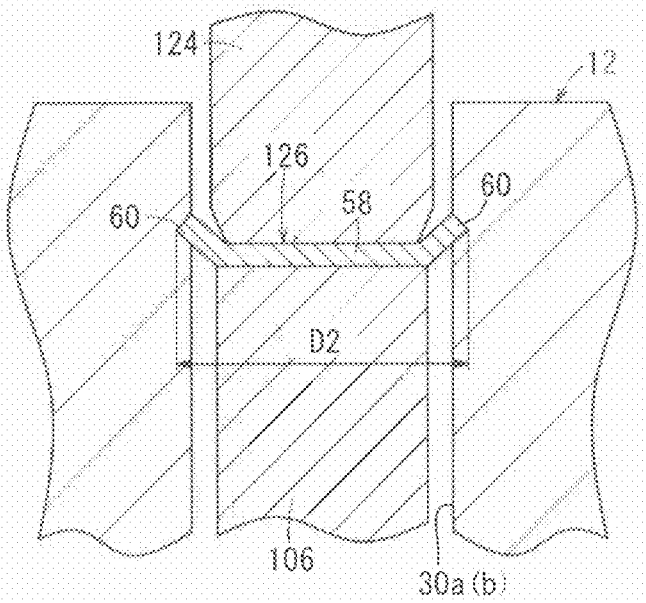
FIG. 11B is an enlarged cross sectional view showing a condition in which the plate body is expanded in diameter by the first punch and the second punch to form the cap.

The plate body 56 that forms the cap 46 is not limited to the case of being formed with a curved shape in cross section, as described above. For example, as shown in FIG. 11A, a plate body 122 having a bent portion (latching section) 120, the outer edge of which has been bent upwardly beforehand, may be used, and a cap 126 may be formed using a second punch 124 that corresponds to the cross sectional shape of the plate body 122 (see FIG. 11B). In this case, because the bent portion 120 is formed beforehand in the plate body 122, the bent portion (latching section) 60 on the cap 126 can be formed more reliably and with higher precision, such that when the caps 126 are installed inside the penetrating holes 30*a*, 30*b*, the bent portions 60 can reliably bite into and become latched with respect to the inner circumferential surfaces of the penetrating holes 30*a*, 30*b*.

Figure 12A:
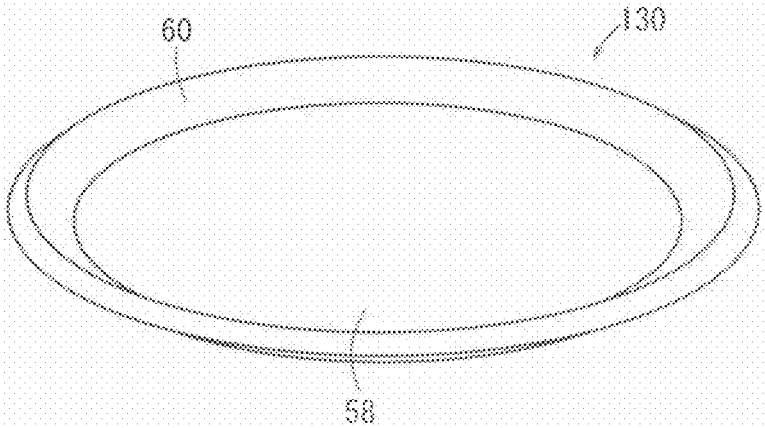
FIG. 12A is an external perspective view of a cap according to a second modification.
Figure 12B:
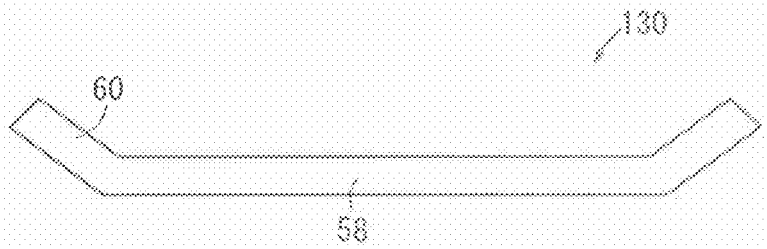
FIG. 12B is a cross sectional view of the cap.
Figure 13A:
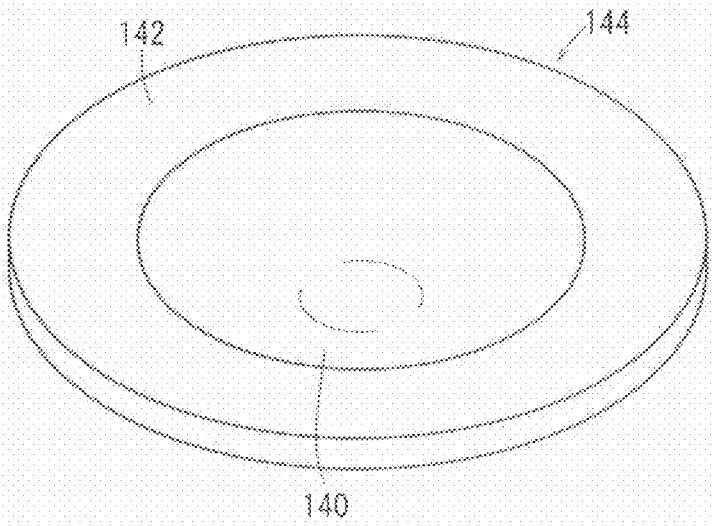
FIG. 13A is an external perspective view of a cap according to a third modification.
Figure 13B:
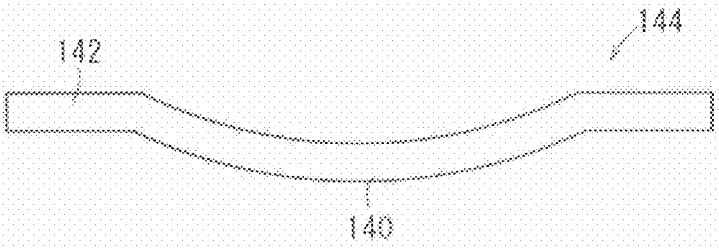
FIG. 13B is a cross sectional view of the cap.

Further, in place of the above-described caps 46, 126, a cap 130 may be used having an elliptical shape, as shown in FIGS. 12A and 12B, or a cap 144 may be used having a main body portion 140 with a curved shape in cross section and a flat portion 142 that is formed on the outer edge of the main body portion 140, as shown in FIGS. 13A and 13B. Further, in the case that the cap 130 shown in FIGS. 12A and 12B is used, the shapes of the penetrating holes 30*a*, 30*b* in the cylinder main body 12 in which the caps 130 are installed also are elliptically shaped.

Further, with the cap 144 shown in FIGS. 13A and 13B, the main body portion 140 is plastically deformed into a planar state as a result of being press molded by the first and second punches 106, 108, accompanied by flowing plastically in a radial outward direction together with the flat portion 142. As a result, the cap 144 is formed entirely in a planar shape, and the outside diameter thereof becomes expanded. Owing thereto, the outer peripheral region of the cap 144 bites into and is latched perpendicularly with respect to inner circumferential surfaces of the penetrating holes 30*a*, 30*b*.

Figure 14:
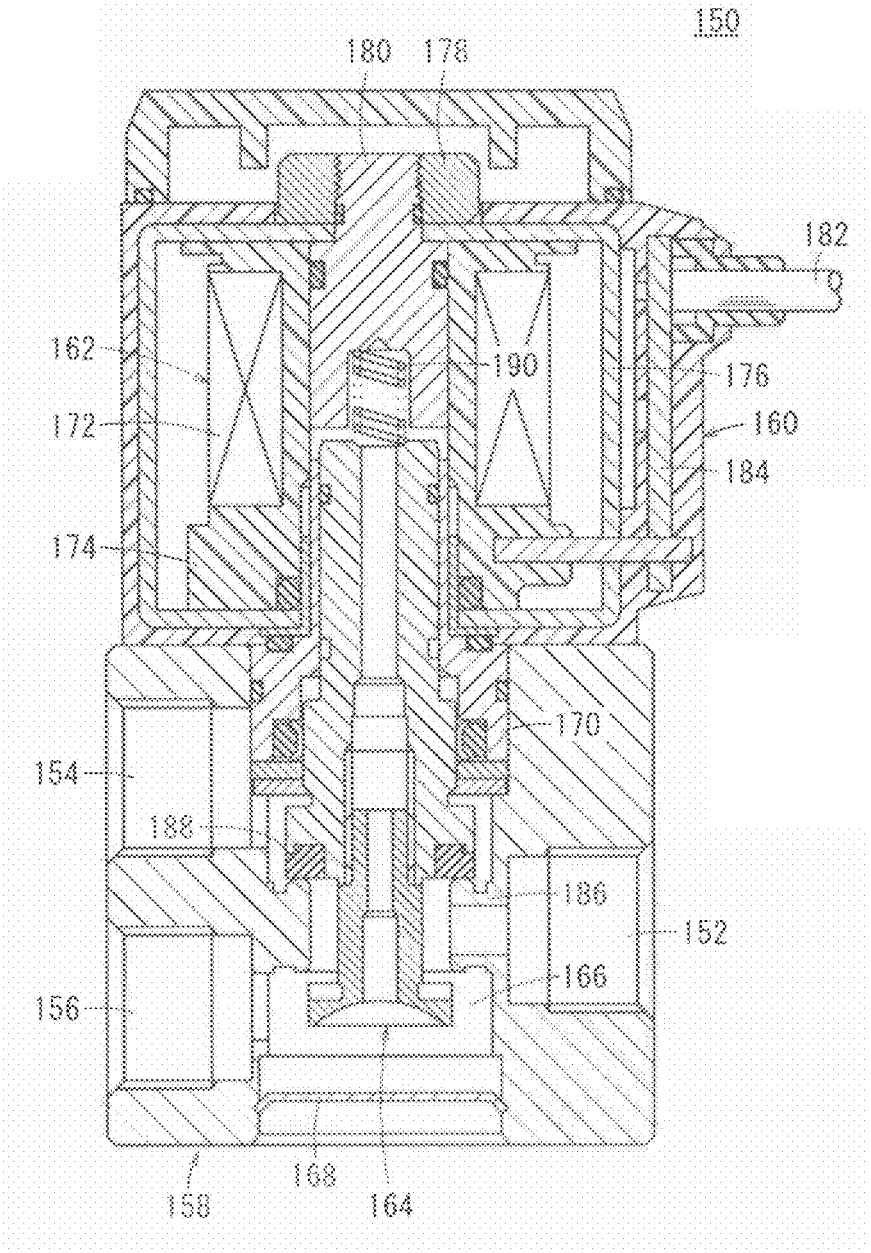
FIG. 14 is an overall cross sectional view of a flow regulating valve in which a cap according to a second embodiment of the present invention is used.

Next, FIG. 14 shows a flow regulating valve 150 in which a cap 168 according to a second embodiment of the present invention is used.

As shown in FIG. 14, the flow regulating valve 150 includes a valve body (body) 158 having a supply port 152 to which a pressure fluid is supplied, and first and second exhaust ports 154, 156 through which the pressure fluid is discharged, a solenoid 162 accommodated in the interior of a bonnet 160, which is disposed on an upper portion of the valve body 158, and a valve plug (displaceable body) 164, which switches communication states between the supply port 152 and the first and second exhaust ports 154, 156 by excitation of the solenoid 162.

On one side surface of the valve body 158, the supply port 152, which opens to the exterior, is disposed. The supply port 152 is connected via piping or the like to a non-illustrated pressure fluid supply source, and pressure fluid is supplied thereto. On the other hand, on the other side surface of the valve body 158, the first and second exhaust ports 154, 156 are disposed, through which the pressure fluid supplied by the supply port 152 is selectively exhausted.

Further, roughly in the center of the valve body 158, a communication chamber (chamber) 166 is formed through which the supply port 152 and the first and second exhaust ports 154, 156 communicate. The communication chamber 166 is formed to open downwardly. The opening of the communication chamber 166 extends downwardly with a substantially constant diameter, and a cap 168 is installed in the vicinity of the opening. The cap 168 is installed such that the bent portion 60 is on the lower side, and such that the angle of the bent portion 60 bites into the inner wall surface of the communication chamber 166. Owing thereto, the communication chamber 166 is sealed by the cap 168. At an upper portion of the communication chamber 166, a holder 170 is disposed in which a later-described valve plug 164 is displaceably retained. Concerning the material of the cap 168, the shape thereof, etc., because they are basically the same as those of the cap 46 according to the aforementioned first embodiment, detailed explanation of such features is omitted.

The solenoid 162 is made up from a bobbin 174 around which a coil 172 is wound, a fixed iron core 180 fixed by a nut 178 with respect to a casing 176 installed inside of the bonnet 160, and the valve plug 164, which is disposed displaceably along the axial direction inside the bobbin 174. The solenoid 162 is installed such that the fixed iron core 180 and the valve plug 164 are arranged coaxially. Additionally, a connection plate 184, which is connected to electrical wires 182 disposed inside the bonnet 160, is connected electrically to the bobbin 174, so that by supply of current through the electrical wires 182, the coil 172 is excited to produce an electromagnetic force.

On a lower end of the valve plug 164, a seat portion 188 is provided, which is seated on the valve seat 186 of the valve body 158. A spring 190 is interposed between an upper end of the valve plug 164 and the fixed iron core 180. Additionally, the valve plug 164 is biased by the elastic force of the spring 190 in a direction to separate away from the fixed iron core 180, such that when the solenoid 162 is excited, the valve plug 164 is drawn toward the side of the fixed iron core 180 in opposition to the elastic force.

In the aforementioned second embodiment, a cap 168 is disposed in the interior of the communication chamber 166 formed in the valve body 158. The bent portion 60 of the cap 168 is installed so as to bite into the inner wall surface of the communication chamber 166, whereby the cap 168 can reliably and easily seal the communication chamber 166. As a result, external leakage of pressure fluid that flows from the supply port 152 to the communication chamber 166 can reliably be prevented.

Further, in the second embodiment, effects which are the same as those of the cap 46 used in the fluid pressure cylinder 10 according to the aforementioned first embodiment can be achieved.

The cap for use in a fluid pressure device and the fixing method therefor according to the present invention are not limited to the above-described embodiments. It is a matter of course that various modified or additional structures could be adopted without deviating from the essence and gist of the present invention.

What is claimed is:

1. A fixing method for fixing a cap in a fluid pressure device including a body having a chamber therein into which a pressure fluid flows, to seal an open end portion of the chamber, the open end portion communicating the chamber with a region exterior to the body, comprising the steps of:

locating in an interior of the chamber a plate body having an arcuate portion exhibiting a concavity defined by the arcuate portion, the concavity facing toward the open end portion, the plate body having a cross sectional area that is equal to or less than a cross sectional area of the chamber; and gripping both sides of the plate body along an axial direction inside the chamber while pressing both sides of the plate body and causing the plate body to plastically expand in diameter at least in a radial outward direction sufficiently to bite into the wall of the body having the chamber therein, wherein the step of gripping both sides of the plate body is performed so as to cause the arcuate portion of the plate body to be plastically deformed to become planar in shape.

2. The fixing method for a cap according to claim 1, wherein the step of locating the plate body in the interior of the chamber comprises inserting the plate body inside the chamber, further comprising the step of, after having inserted the plate body inside the chamber, positioning the plate body at a predetermined position along an axial direction in the interior of the chamber.

3. The fixing method for a cap according to claim 2, wherein a diameter of the plate body, prior to said gripping step, is sufficiently smaller than a diameter of the predetermined position in the interior of the chamber that the plate body is able to be inserted in said inserting step without the plate body sliding on the inner circumference of the chamber.

4. The fixing method for a cap according to claim 1, wherein the step of gripping both sides of the plate body while pressing and plastically deforming the plate body is performed using a molding jig located in the interior of the chamber.

* * * * *